United States Patent [19]

Kunig

[11] Patent Number: 4,503,589

[45] Date of Patent: Mar. 12, 1985

[54] NEEDLE BAR DRAWING DEVICE

[75] Inventor: Helmut Kunig, Bad Schwartau, Fed. Rep. of Germany

[73] Assignee: S.A. des Ateliers Houget Duesberg Bosson, Ensival, Belgium

[21] Appl. No.: 509,338

[22] Filed: Jun. 30, 1983

[30] Foreign Application Priority Data

Jul. 3, 1982 [DE] Fed. Rep. of Germany ..... 3224936

[51] Int. Cl.[3] ..... D01G 19/06

[52] U.S. Cl. ..... 19/129 R

[58] Field of Search ..... 19/129 R

[56] References Cited

U.S. PATENT DOCUMENTS

| | | | |
|---|---|---|---|
| 4,070,732 | 1/1978 | Herubel | 19/129 R |
| 4,169,301 | 10/1979 | Kaisep | 19/129 R |
| 4,293,983 | 10/1981 | Van Deusen et al. | 19/129 R |
| 4,351,089 | 9/1982 | Jahnke et al. | 19/129 R |
| 4,400,853 | 8/1983 | Nagel | 19/129 R |

FOREIGN PATENT DOCUMENTS

| | | | |
|---|---|---|---|
| 46738 | 3/1982 | European Pat. Off. | 19/129 R |
| 165597 | 1/1905 | Fed. Rep. of Germany . | |
| 813670 | 7/1951 | Fed. Rep. of Germany . | |
| 913272 | 4/1954 | Fed. Rep. of Germany | 19/129 R |
| 953589 | 11/1956 | Fed. Rep. of Germany . | |
| 1057507 | 5/1959 | Fed. Rep. of Germany . | |
| 1146966 | 11/1957 | France | 19/129 R |
| 405787 | 9/1943 | Italy | 19/129 R |
| 438340 | 8/1948 | Italy | 19/129 R |

*Primary Examiner*—Louis K. Rimrodt

*Attorney, Agent, or Firm*—Edward F. Levy

[57] ABSTRACT

In a needle bar drawing device (gill box) for the drawing of card slivers bars carrying needles are led without being connected to each other. In a device which, according to today's terminology, is to be identified as a push bar draw frame pairs of driven toothed discs engaging each other with their toothed peripheries are so arranged that they almost totally cover the whole orbit of the needle bars with their toothing engaging the shafts of the latter.

13 Claims, 4 Drawing Figures

Fig. 1
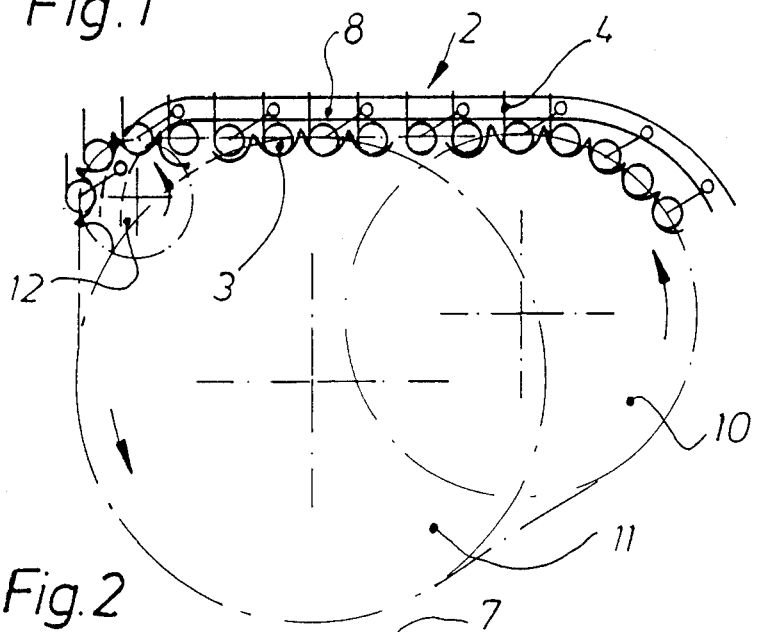
Fig. 2
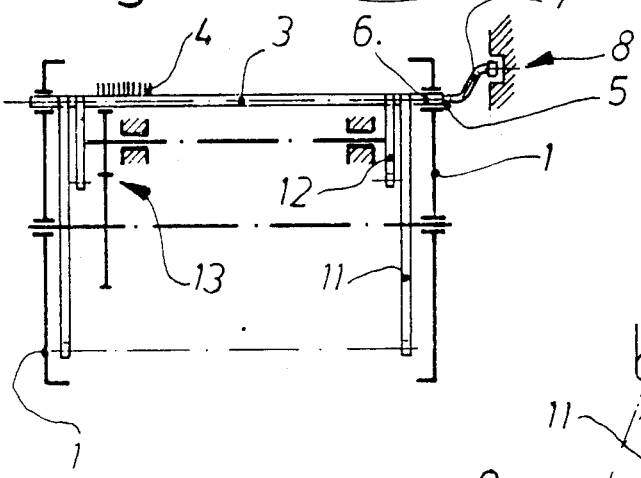
Fig. 3
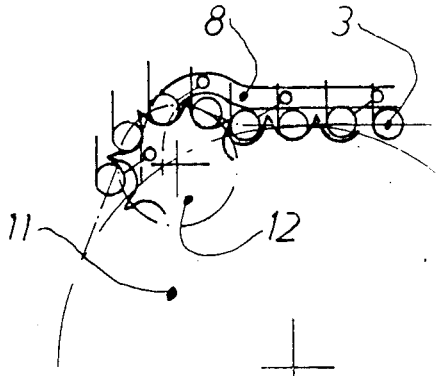
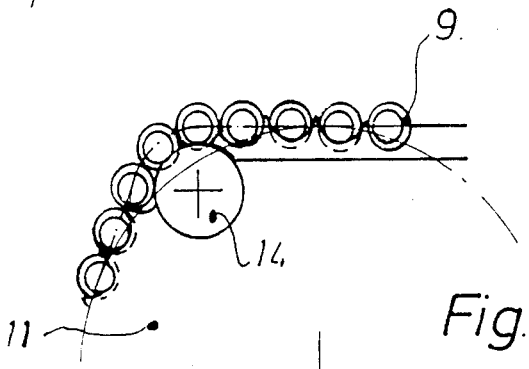
Fig. 4

NEEDLE BAR DRAWING DEVICE

BACKGROUND OF THE INVENTION

1. Field of the Invention

The invention concerns a needle bar drawing device (gill box for drawing card slivers, the device comprising a driven gilling area (needle field) of needle bars arranged independently of each other having cranks guided in a channel cam and arranged at least at one of their ends, and comprising slot guides for the needle bars, the slot guides determining the orbit of the needle bars during their total run and arranged on both sides of the gilling area.

2. Description of Prior Art

A needle bar drawing device of this species is known from German Letters Patent 165 597. This device which is called a push bar drawing equipment according to present terminology has needle bars guided in slot guides on both sides of the gilling area, which bars are controlled by cranks in respect of the position of the needles. The driving of the needle bars is performed by means of toothed discs or crown gears whose toothing protrudes into their path and which conveyingly engage some needle bars. The pitch of the toothed discs corresponds to that determined by the diameter of the bar body.

A device which corresponds in the essential details to the known device can also be taken from German Pat. Nos. 813 670 and 953 589 in which, however, the pitch of the needle bars is determined by spacer bodies arranged on their shafts.

In practice drawing equipments of this constructional type have a greater tendency to pitch change due to wearing which can be noticed in a disturbing manner by way of synchronisation problems when two gilling areas which engage or mesh with each other or when driven holding down means engaging the needles are used. Furthermore, the noise level increases very quickly and vigourously, especially when e.g. the usual efficiency is to be achieved in chain drawing equipment. The reason for this is that the conveying engagement of the toothed discs is only effective on those needle bars which are in contact with the toothed discs. The other needle bars must be pushed by these few directly driven needle bars against the slippage resistance resp. gliding friction which occurs in the crank guide and the guide path which determines the orbit, whereas in the working slack this pushing has to be performed via the spacer bodies against the drawing forces. This means that a resistance has to be overcome which corresponds to the sum value of the single resistances of all needle bars positioned between two driving points.

The endeavour to meet this deficiency finally led to the suggestion of a push bar drawing equipment which is described in German Pat. No. 1 057 507. In this embodiment the number of needle bars positively conveyed during their orbit is raised by the engagement of an additional pair of driven toothed discs which partly reduces the disclosed wearing characteristics without solving the problem satisfactorily.

OBJECT OF THE INVENTION

It is therefore the main object of the invention to suggest a needle bar drawing device in which each needle bar of the gilling area is in driven engagement during almost its total orbit.

SUMMARY OF THE INVENTION

This object is achieved according to the invention in that the driving of the needle bars is effected by means of several toothed discs, each of which is driven, whose peripheries overlap each other, which are arranged offset with respect to each other, and whose toothing engages the orbit of the needle bars by positively engaging the same.

The advantages which can thereby be achieved also consist in that a very small pitch of the needle bar can be realised. Furthermore, the reversing radius at the place where the needles disappear can be chosen to be very small which allows for a very small nip and effects an accelerated exit of the needles from the card sliver, thus enabling the processing of short-stapled fibre material at speeds which are usual in chain drawing devices.

According to an advantageous embodiment of the invention the toothed discs are each arranged in pairs engaging synchronously the shafts of the needle bars.

In order to reduce the tendency to lap formation the pair of toothed discs located in the region of the place where the needle bars disappear from the gilling area can be driven at a peripheral speed greater than that of the toothed discs. The increased peripheral speed can be achieved in that the toothed discs are driven at a basic speed corresponding to the speed of the gilling area, acceleration impulses being superimposed on the basic speed after each reception of one of the needle bars. Providing the toothed discs with saw-like toothing including trailing shoulders adds to improve the transition of the needle bars especially in these two embodiments.

A further shortening of the nip as well as the use of shorter needles with the result of a reduction in the tendency to lap formation enables an arrangement of the toothed disc pair positioned in the region where the needle bars disappear such that they protrude with their periphery beyond the plane of the gilling area.

In order to ensure a continuous transition of the needle bars from one toothed disc to the next one, idle auxiliary toothed discs may be arranged at each transitional place between the peripheries of the toothed discs.

A simplified embodiment with shortened nip and accelerated exit of the needles from the card sliver can be achieved if the reversing of the needle bars in the region of the vanishing places is performed by means of non-toothed driven or idler pulleys. In such a case the needle bars may be provided in the region of their shafts positioned on both sides of the gilling area with spacer means for providing uniform spaces between the needle bars.

BRIEF DESCRIPTION OF THE DRAWINGS

Other and further objects of the present invention will be apparent from the following description and claims and are illustrated in the accompanying drawings which by way of illustration schematically show preferred embodiments of the present invention and the principles thereof and what now are considered to be the best modes contemplated for applying these principles. Other embodiments of the invention embodying The same or equivalent principles may be used and structural changes may be made as desired by those skilled in the art without departing from the present invention and the scope of the appended claims.

In the drawings:

FIG. 1 shows a partially sectionally represented schematic side view of a needle bar drawing device according to the basic concept of the invention, FIG. 2 shows a cross-section through the device represented in the same way with a needle bar, FIG. 3 shows a partially sectional side view of a modified embodiment of the device, and FIG. 4 shows a further modification by way of a partially sectional side view.

DETAILED DESCRIPTION OF THE PREFERRED EMBODIMENT

Needle bars 3 which form a needle field 2 for a card sliver to be drawn and are set with needles 4 are driven along an endless orbit or path in a framework arranged between not shown input and draft rollers of a needle bar drawing device (gill box) and comprising essentially two side walls 1 only represented schematically. The orbit is determined by guiding channels 5 provided in the side walls 1. The needle bars 3 include shafts 6 by which they are guided in the guiding channels 5. Cranks 7 arranged at one end of each needle bar 3 ensure the alignment of the needles 4 during their run, the cranks being guided in a channel cam 8 secured to the frame and associated alternatingly to the ends of neighbouring needle bars 3. The shafts 6 of the needle bars 3 are provided with spacer means 9 not shown in FIGS. 1 and 3 for the sake of clarity, which spacer means ensure the distance resulting in the pitch of the needle bars 3. The advance movement of the needle bars 3 is created by means of several, according to FIG. 1 three, pairs of rotatingly driven toothed discs 10, 11, 12. Their arrangement is such that their peripheries engaged with the pitch of the needle bars 3 are congruent with the largest part of the orbit of the needle bars 3. For this purpose the toothed discs 10, 11, 12 are offset in pairs and mounted in the side walls 1 with their peripheries overlapping. The peripheries of the toothed discs 10, 11, 12 cover the orbit of the needle bars 3 by engagement of the toothing with the shafts 6 in such a manner that the needle bars 3 are engaged to be conveyed in the region of their transfer into the drawing plane by the tooth discs 10, in the region of the return and simultaneously the drawing plane by the toothed discs 11 and in the region where the needles vanish from the drawing plane by the toothed discs 12 of small diameter. The synchronisation of the toothed discs is brought about by a gear 13 only partially shown in FIG. 2.

In a modified embodiment according to FIG. 3 the toothed discs 12 are so arranged that their peripheries rise above the drawing plane, the run of the guiding channels 5 and the channel cams 8 being arranged correspondingly.

According to FIG. 4 instead of toothed discs 12 untoothed rollers 14 of small diameter are provided which are arranged in a driven manner or to run freely.

What is claimed is:

1. Needle bar drawing device (gill box) for drawing card slivers, said device comprising driven gilling area means including needle bar means running along an endless orbit, defining two ends and carrying needle means, which needle bar means are arranged independently of each other and at least at one of said ends, and include crank means guided in channel cam means, said device further comprising slot guide means for said needle bar means, said slot guide means determining said orbit of said needle bar means during their total run and arranged on each side of said gilling area means, wherein said needle bar means are driven by means of several toothed disc means, said toothed disc means being driven, having at least two peripheries overlapping each other, being arranged offset with respect to each other, and the toothings of which engage said orbit of said needle bar means by positively engaging the same.

2. Needle bar drawing device as claimed in claim 1, wherein said needle bar means define shaft means, said toothed disc means each being arranged in pairs engaging said shaft means of said needle bar means synchronously.

3. Needle bar drawing device as claimed in claim 2, wherein a first one of said pairs of toothed disc means located in the region of the position where said needle bar means vanish from said gilling area means are driven at a greater circumferential speed than that of the other pairs of said toothed disc means.

4. Needle bar drawing device as claimed in claim 3, wherein said first pair of toothed disc means is driven at a basic speed corresponding to the speed of said gilling area means, which basic speed is superimposed by acceleration impulses after receiving each one of said needle disc means.

5. Needle bar drawing device as claimed in claim 3, wherein said first pair of toothed disc means has a saw-like toothing including trailing shoulders.

6. Needle bar drawing device as claimed in claim 4, wherein said first pair of toothed disc means has a saw-like toothing including trailing shoulders.

7. Needle bar drawing device as claimed in claim 3, wherein said first pair of toothed disc means positioned in the region of said vanishing position of said needle bar means protrude with their periphery beyond a plane of said gillings area means.

8. Needle bar drawing device as claimed in claim 2, wherein said device includes non-toothed driven pulleys to reverse said run of said needle bar means in the region of said position where said needle bar means vanish from said gilling area means.

9. Needle bar drawing device as claimed in claim 2, wherein said device includes non-toothed idler pulleys to reverse said run of said needle bar means in the region of said position where said needle bar means vanish from said gilling area means.

10. Needle bar drawing device as claimed in claim 1, wherein idle auxiliary toothed disc means are arranged at each transitional place between the peripheries of said toothed disc means.

11. Needle bar drawing device as claimed in claim 1, wherein said device includes non-toothed driven pulleys to reverse said run of said needle bar means in the region of said position where said needle bar means vanish from said gilling area means.

12. Needle bar drawing device as claimed in claim 1, wherein said device includes non-toothed idler pulleys to reverse said run of said needle bar means in the region of said position where said needle bar means vanish from said gilling area means.

13. Needle bar drawing device as claimed in claim 1, wherein said needle bar means define shaft means positioned on both sides of said gilling area means and carry spacer means for providing uniform spaces between said needle bar means in the region of said shaft means.

* * * * *